US010198947B2

(12) United States Patent
Meyer et al.

(10) Patent No.: US 10,198,947 B2
(45) Date of Patent: Feb. 5, 2019

(54) EMITTER PROGRAMMER AND VERIFICATION SYSTEM

(71) Applicant: Global Traffic Technologies, LLC, St. Paul, MN (US)

(72) Inventors: Charles B. Meyer, River Falls, WI (US); Kevin Eichhorst, Owatonna, MN (US); Timothy J. Hall, Hudson, WI (US)

(73) Assignee: Global Traffic Technologies, LLC, St. Paul, MN (US)

( * ) Notice: Subject to any disclaimer, the term of this patent is extended or adjusted under 35 U.S.C. 154(b) by 29 days.

(21) Appl. No.: 15/254,683

(22) Filed: Sep. 1, 2016

(65) Prior Publication Data

US 2018/0061229 A1 Mar. 1, 2018

(51) Int. Cl.
*G08G 1/087* (2006.01)
*G08C 23/04* (2006.01)

(52) U.S. Cl.
CPC ..... *G08G 1/087* (2013.01); *G08C 23/04* (2013.01); *G08C 2201/20* (2013.01)

(58) Field of Classification Search
None
See application file for complete search history.

(56) References Cited

U.S. PATENT DOCUMENTS 5,014,052 A 5/1991 Obeck
5,027,260 A 6/1991 Lyons et al.
5,172,113 A 12/1992 Hamer
5,187,476 A 2/1993 Hamer
5,237,663 A * 8/1993 Srinivasan ..... G06F 3/0231 710/305
5,661,374 A 8/1997 Cassidy et al.
5,826,965 A 10/1998 Lyons
5,988,839 A 11/1999 Pokorney et al.
6,064,319 A 5/2000 Matta
6,299,337 B1 10/2001 Bachl et al.
6,326,903 B1 12/2001 Gross et al.
6,682,210 B1 1/2004 Ford et al.
(Continued)

OTHER PUBLICATIONS

International Search Report and Written Opinion dated Dec. 4, 2017, for corresponding International Patent Application PCT/US2017/048881.

*Primary Examiner* — Joseph Feild
*Assistant Examiner* — John Mortell
(74) *Attorney, Agent, or Firm* — Crawford Maunu PLLC

(57) ABSTRACT

The disclosure describes a device for configuring an infrared (IR) emitter. The device includes a support structure and a microprocessor attached to the support structure. An interface circuit is also attached to the support structure and is configured to provide communications between the microprocessor and a portable computing device. A memory, which is attached to the support structure, is coupled to the microprocessor and is configured with instructions. Execution of the instructions by the microprocessor cause the microprocessor to communicate with an application executing on the portable computing device and initiate transmission of configuration data received from the application to the IR emitter. A transmitter is attached to the support structure and is coupled to the microprocessor. The transmitter is configured to transmit the configuration data to the IR emitter.

18 Claims, 4 Drawing Sheets

(56) References Cited

U.S. PATENT DOCUMENTS

| | | | | |
|---|---|---|---|---|
| 6,863,424 | B2 | 3/2005 | Smith | |
| 7,411,174 | B2 | 8/2008 | Eash | |
| 7,429,917 | B2 | 9/2008 | Fredericks et al. | |
| 7,808,401 | B1 | 10/2010 | Schwartz et al. | |
| 2004/0174712 | A1 | 9/2004 | Yagi | |
| 2006/0273926 | A1 | 12/2006 | Schwartz | |
| 2008/0003993 | A1* | 1/2008 | Rye | G08C 17/00 455/418 |
| 2011/0298581 | A1* | 12/2011 | Hsu | H04N 21/42208 340/4.3 |
| 2012/0218126 | A1 | 8/2012 | Roberts et al. | |
| 2014/0200760 | A1 | 7/2014 | Kaufmann et al. | |
| 2014/0327778 | A1* | 11/2014 | McQuade | G08G 1/0175 348/156 |

* cited by examiner

EMITTER PROGRAMMER AND VERIFICATION SYSTEM

TECHNICAL FIELD

The disclosure is generally directed to configuring infrared emitters for traffic control preemption systems.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signalized intersections by making preemption requests to the intersection controllers that control the traffic lights at the intersections. The intersection controller may respond to the preemption request from the vehicle by changing the intersection lights to green in the direction of travel of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), located in or on the emergency vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle.

The emitter on a vehicle may be configurable so that it is associated with a vehicle class, vehicle identifier, and a government agency, for example. The emitter may encode this information in the light pulses for processing by the intersection equipment. The intersection equipment may use this information in prioritizing preemption requests and logging preemption data.

The Opticom™ 794H LED emitter from Global Traffic Technologies, LLC, is an example of an emitter that generates pulses of infrared light that encode preemption requests. The 794H LED emitter is also configurable via an infrared interface and a handheld infrared remote coding unit.

SUMMARY

In one implementation, a device for configuring an infrared (IR) emitter is provided. The device includes a support structure and a microprocessor attached to the support structure. An interface circuit is also attached to the support structure and is configured to provide communications between the microprocessor and a portable computing device. A memory, which is attached to the support structure, is coupled to the microprocessor and is configured with instructions. Execution of the instructions by the microprocessor cause the microprocessor to communicate with an application executing on the portable computing device and initiate transmission of configuration data to the IR emitter. A transmitter is attached to the support structure and is coupled to the microprocessor. The transmitter is configured to transmit the configuration data to the IR emitter.

In another implementation, a method of configuring an IR emitter is provided. The method includes establishing communication between a programming device and an application executing on a portable computing device, receiving by the programming device, configuration data from the application, and transmitting the configuration data from the programming device to the IR emitter.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

Figure 1:
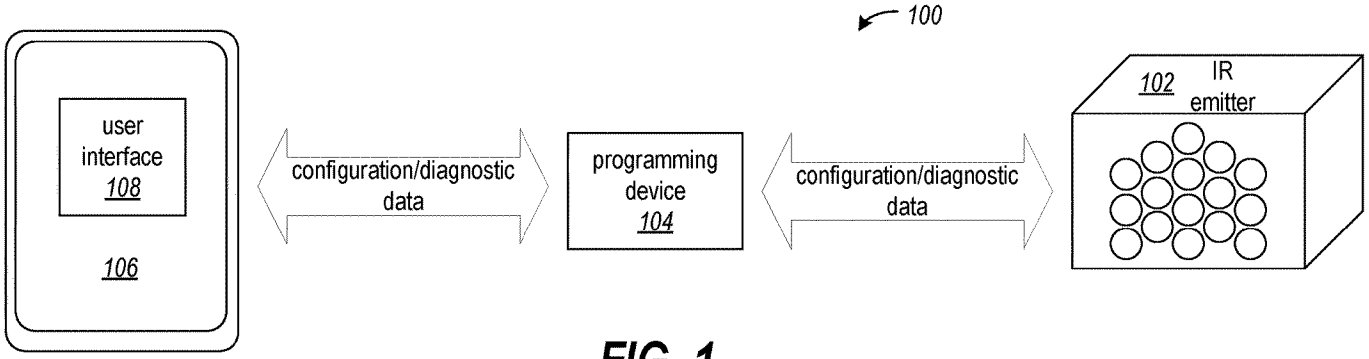
FIG. 1 shows a system in which an IR emitter is configured by a programming device that is controlled by a portable computing device.

In the following description, numerous specific details are set forth to describe specific examples presented herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same element or additional instances of the same element.

Configuring emitters has been found to present a number of challenges. For some emitters, physical access to the emitters is required for cable connections, and accessing the emitters may be cumbersome. For example, an emitter may be disposed on the roof of a fire engine and enclosed within a structure containing other emergency lighting apparatus. A ladder, tools, and cables may be required to access the emitter in the aforementioned scenario. The infrared (IR) configuration interface and handheld unit for some emitters alleviates some challenges of configuring emitters. However, a good line of sight is needed between the handheld unit and the emitter, and bright sunlight may interfere with the IR communications.

This disclosure describes devices and methods for configuring an IR emitter. The ease with which IR emitters may be configured, tested, or updated with new firmware is important to the user experience with the emitter. Many users may be inconvenienced in having to procure and place a ladder, and climb the ladder with a notebook computer or other equipment to configure or test an IR emitter. These and other inconveniences associated with configuring or testing an IR emitter are eliminated with the disclosed devices and methods.

A device for configuring an IR emitter includes a support structure and a microprocessor attached to the support structure. An interface circuit is attached to the support structure, and the interface circuit is configured to provide communications between the microprocessor and a portable computing device, such as a smart phone, tablet computer, notebook computer or other similar devices. A memory is also attached to the support structure and is coupled to the microprocessor. The memory is configured with instructions, and execution of the instructions by the microprocessor causes the microprocessor to communicate with an application executing on the portable computing device, and to initiate transmission of configuration data received from the application to the IR emitter. A transmitter is attached to the support structure, coupled to the microprocessor, and configured to transmit the configuration data to the IR emitter. The support structure may include a circuit board on which the circuit components are mounted and a case to which the circuit board is attached and in which the circuit board is enclosed. The support structure may be structured similar to a dongle, for example.

FIG. 1 shows a system 100 in which an IR emitter 102 is configured by a programming device 104 that is controlled by a portable computing device 106. The portable computing device executes an application program that provides a user interface 108 through which a user may enter and view data for configuring or testing operation of the IR emitter 102. Configuration data, as may be specified via user interface 108, is communicated from the portable computing device to the programming device, and from the programming device to the IR emitter. The configuration data may include the class of vehicle with which the IR emitter is associated, a vehicle identifier of the vehicle to which the IR emitter is assigned and installed, an agency identifier of the entity to which the vehicle belongs, and the model and/or serial number of the IR emitter. Diagnostic data, which is generated by the IR emitter in response to a command entered at the portable computing device, is transmitted from the IR emitter and received by the programming device, and then communicated from the programming device to the portable computing device for display via the user interface. Diagnostic data may include logged error data, a count of the number of times the number of on-off cycles of the LEDs of the IR emitter (flash count), an a number of hours of operations.

The programming device 104 may communicate with the portable computing device 106 via a wireless or a wired connection. Wireless communications may be by Bluetooth or a wireless network connection, for example. A wired connection may include a cable that connects to a USB or micro-USB port (not shown) of the portable computing device.

The IR emitter 102 includes a wireless interface (not shown) for wirelessly communicating with the programming device 104 and for interfacing with control circuitry (not shown) of the IR emitter. The wireless communication between the programming device 104 and the IR emitter may be by Bluetooth, wireless network, cellular communications, IR signaling or other wireless medium.

The portable computing device 106 may be a multipurpose computing device such as a smart phone, tablet computer, or notebook computer, for example. The portable computing device executes an application program that provides the user interface 108 and establishes communications with the programming device 104 and provides configuration data and/or diagnostic commands to the programming device.

Figure 2:
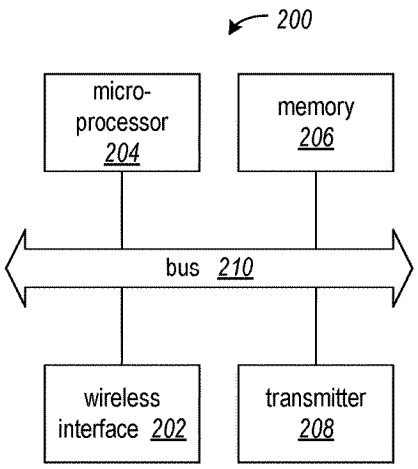
FIG. 2 shows an implementation of a programming device having a wireless interface for communicating with an application on a portable computing device.

FIG. 2 shows an implementation of a programming device 200 having a wireless interface 202 for communicating with an application on a portable computing device. The programming device further includes a micro-processor 204, a memory arrangement 206, and a transmitter 208, all inter-coupled via bus 210. The wireless interface may be a network interface controller that includes a radio signal transceiver and antenna for connecting to a radio signal-based network such as one based on the IEEE 802.11 standard or Bluetooth standard, for example.

The transmitter 208 is configured to wirelessly transmit data and/or commands to the IR emitter. The transmitter may be a network interface controller that connects to a radio signal-based network such as one based on the IEEE 802.11 standard or Bluetooth standard, or may provide IR light signaling, for example. In another implementation, the transmitter may be part of a transceiver (not shown) for connecting and communicating with the IR emitter via an IEEE 802.11 network or a cellular communications network, thereby providing long-range transmission of configuration data and receipt of diagnostic data.

Microprocessor 204 may be any type of processor capable of executing program instructions and suitable for implementation requirements. The memory arrangement 206 may include a hierarchy of memory components ranging from cache memory to retentive storage. The retentive storage may be flash memory for storing executable program code.

The memory arrangement 206 may be configured with instructions that are executable by the microprocessor 204 for transmitting configuration data to the IR emitter. The configuration data may be provided to the programming device via the portable computing device 106 (FIG. 1). The memory arrangement may be further configured with program code that is executable by the portable computing device for providing the user interface 108 and interacting with the programming device. Further still, the memory arrangement may be configured with program code that is executable by the portable computing device for receiving diagnostic data from the IR emitter and forwarding the diagnostic data to the application on the portable computing device. The bus 210 may include multiple buses for communicating data, address and control signals between the connected components.

Figure 3:
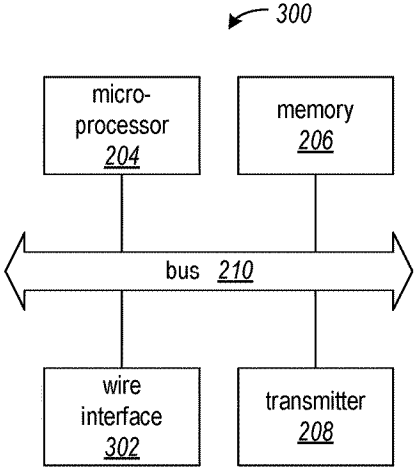
FIG. 3 shows an implementation of a programming device having a wire interface for connecting the programming device to a portable computing device.

FIG. 3 shows an implementation of a programming device 300 having a wire interface 302 for connecting the programming device to a portable computing device. The wire interface 302 may implement a micro-USB or USB connection, for example.

Figure 4:
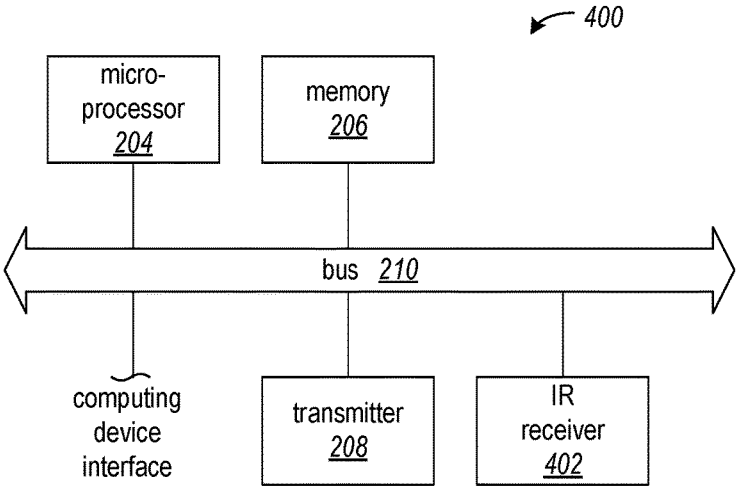
FIG. 4 shows an implementation of a programming device having an IR receiver for receiving an IR light signal from the emitter and providing data from the signal to the microprocessor for verification.

FIG. 4 shows an implementation of a programming device 400 having an IR receiver 402 for receiving an IR light signal from the emitter and providing data from the signal to the microprocessor for verification. The IR receiver includes circuitry for detecting an IR light signal, decoding the IR light signal into electrical signals, and communicating data represented in the electrical signals to the microprocessor.

The IR receiver 402 may be used in supporting diagnostic operations on the IR emitter. For example, the memory arrangement 206 may be configured with instructions that are executable by the microprocessor for initiating transmission of a request or command to the IR emitter for diagnostic data. The request or command may have been first received by the programming device 400 from the portable computing device 106 (FIG. 1) via the computing device interface. The microprocessor inputs the diagnostic data, as decoded by the IR receiver 402, and communicates the diagnostic data to the application executing on the portable computing device.

Figure 5:
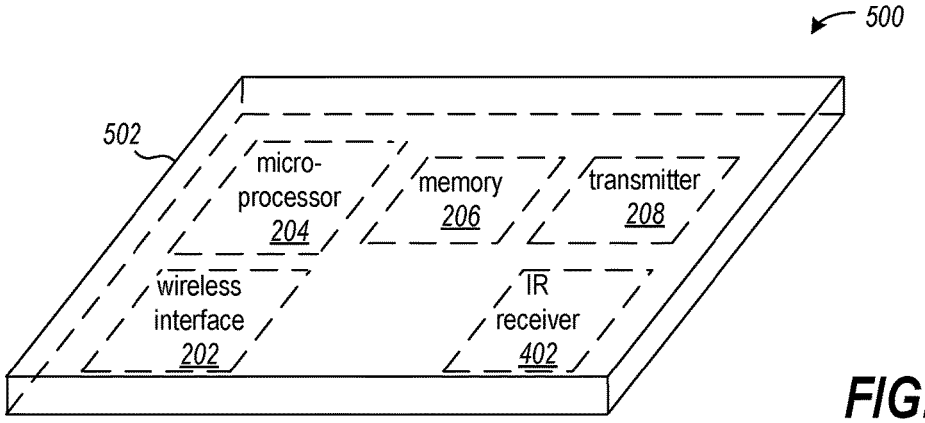
FIG. 5 shows a programming device in which the components are attached to a support structure, and the programming device has a wireless interface for connecting to a portable computing device.

FIG. 5 shows a programming device 500 in which the components are attached to a support structure 502, and the programming device has a wireless interface for connecting to a portable computing device. The support structure 502 may include a circuit board on which the wireless interface 202, microprocessor 204, memory 206, transmitter 208, and IR receiver 402 are mounted and communicatively interconnected. The circuit board may be attached to a housing or case that encloses the circuit board and attached components. Other implementations may have multiple ones of the components constructed as a system on a chip (SOC).

Figure 6:
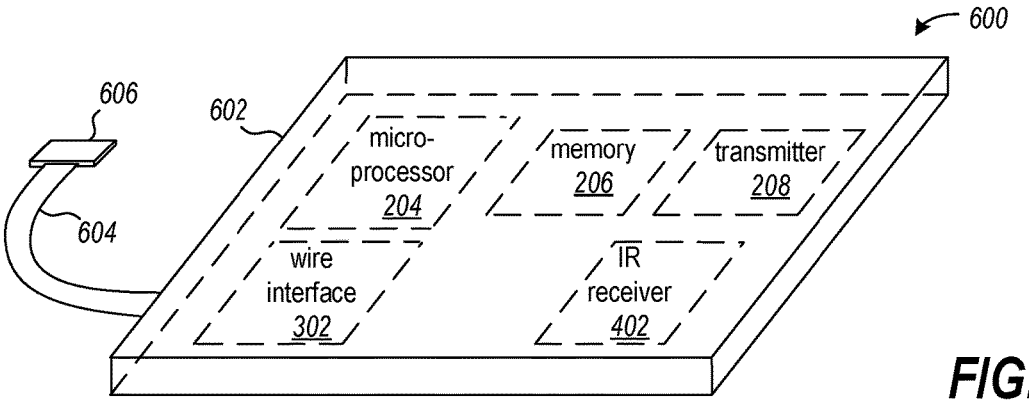
FIG. 6 shows a programming device in which the components are attached to a support structure, and the programming device has a wire interface for connecting to a portable computing device.

FIG. 6 shows a programming device 600 in which the components are attached to a support structure 602, and the programming device has a wire interface 302 for connecting to a portable computing device. The support structure 602 may include a circuit board on which the wire interface 302, microprocessor 204, memory 206, transmitter 208, and IR receiver 402 are mounted and communicatively interconnected. The circuit board may be attached to a housing or case that encloses the circuit board and attached components. Other implementations may have multiple ones of the components constructed as a system on a chip (SOC).

The wire interface 302 is coupled to the cable 604 and connector 606, and the cable may be either permanently attached or detachable from the support structure. The connector is configured to mechanically and electrically connect to a data port on the portable computing device. The connector and cable may be micro-USB compatible, or compatible with another similar interface.

Figure 7:
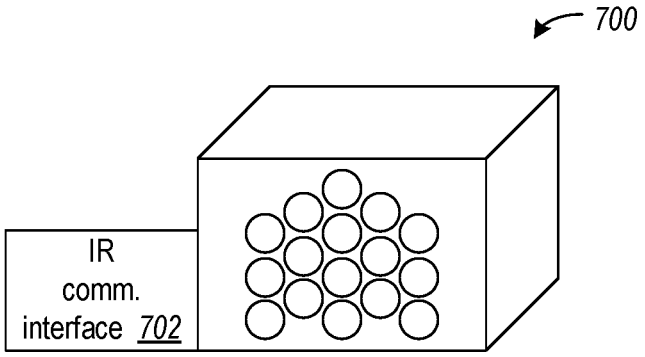
FIG. 7 shows an IR emitter having an IR communications interface.

FIG. 7 shows an IR emitter 700 having an IR communications interface 702 through which the emitter can be configured via IR signaling. The IR communications interface includes an IR light detector and circuitry for converting the IR signal into an electrical signal for input to control circuitry of the IR emitter.

Figure 8:
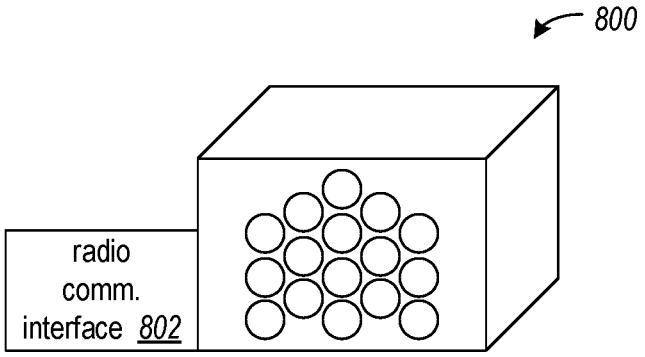
FIG. 8 shows an alternative IR emitter having a radio communications interface.

FIG. 8 shows an alternative IR emitter 800 having a radio communications interface 802 through which the emitter can be configured via radio signaling specified in the IEEE 802.11 standard or the Bluetooth standard, or in a cellular network, for example. The radio communications interface includes an antenna and circuitry for converting the radio signal into an electrical signal for input to control circuitry of the IR emitter.

Figure 9:
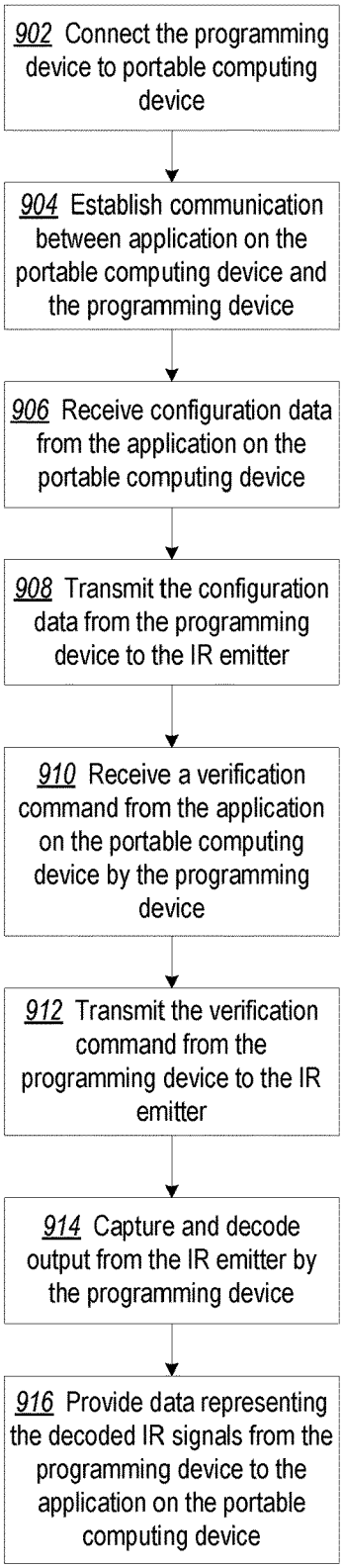
FIG. 9 is a flowchart of a process for configuring and verifying the configuration of an IR emitter.

FIG. 9 is a flowchart of a process for configuring and verifying the configuration of an IR emitter. At block 902, the programming device is connected to the portable computing device. It will be appreciated that for a programming device having a wireless interface to the portable computing device, no physical connection need be made. At block 904, communication is established between the programming device and the portable computing device according to the protocol of the interface. In one implementation, the programming device stores program code that is executable by the portable computing device. The program code may be loaded by the portable computing device and executed to provide an application program and user interface for configuring and/or testing the IR emitter. In an alternative implementation, the program code may be stored as an available application on the portable computing device.

At block 906, configuration data is received from the portable computing device by the programming device. The configuration data may be entered, specified, or referenced via the user interface of the application executing on the portable computing device. Note that the configuration data may include commands and data. The commands may direct the IR emitter to perform configuration of its local registers or memory or direct the IR emitter to perform diagnostic functions. At block 908, the configuration data is transmitted from the programming device to the IR emitter. Depending on the implementation, the configuration data may be transmitted via radio signal or an IR light signal.

At block 910, the programming device receives a verification command from the application on the portable computing device. The verification command is for obtaining diagnostic and configuration information from the IR emitter. For example, the diagnostic information may include logged error data, a count of the number of times the number of on-off cycles of the LEDs of the IR emitter (flash count), and a number of hours of operation. The configuration information read-back from the IR emitter may include the class of vehicle with which the IR emitter is associated, a vehicle identifier of the vehicle to which the IR emitter is assigned and installed, an agency identifier of the entity to which the vehicle belongs, and the model and/or serial number of the IR emitter.

At block 912, the verification command is transmitted from the programming device to the IR emitter. The command may be encoded in a radio signal or an IR light signal and transmitted accordingly, depending on the implementation. At block 914, output from the IR emitter is captured and converted by the programming device into electrical signals that represent the diagnostic data. The output may be an IR light signal and/or a radio signal, depending on the implementation of the IR emitter and programming device. The diagnostic data is communicated from the programming device to the application on the portable computing device at block 916. The application may then display the diagnostic data on the portable computing device for review by a user.

Though aspects and features may in some carriers be described in individual figures, it will be appreciated that features from one figure can be combined with features of another figure even though the combination is not explicitly shown or explicitly described as a combination.

The present invention is thought to be applicable to a variety of systems for controlling the flow of traffic. Other aspects and embodiments of the present invention will be apparent to those skilled in the art from consideration of the specification and practice of the invention disclosed herein. It is intended that the specification and illustrated embodiments be considered as examples only, with a true scope of the invention being indicated by the following claims.

What is claimed is:

1. A device for configuring an infrared (IR) emitter, comprising:

a support structure;

a microprocessor attached to the support structure;

an interface circuit attached to the support structure and configured to provide communications between the microprocessor and a portable computing device;

a memory attached to the support structure and coupled to the microprocessor, wherein the memory is configured with instructions and execution of the instructions by the microprocessor cause the microprocessor to:

communicate with an application executing on the portable computing device; and initiate transmission of commands to the IR emitter, wherein the commands cause the IR emitter to:

program memory of the IR emitter with configuration data including a vehicle identifier of a vehicle to which the IR emitter is assigned; and transmit, from the memory of the IR emitter, data associated with operation of the IR emitter; and a transceiver attached to the support structure and coupled to the microprocessor, wherein the transceiver includes an IR receiver attached to the support structure and coupled to the microprocessor, and the transceiver is configured to:

transmit the commands and the configuration data to the IR emitter; and receive from the IR emitter data transmitted in response to the commands;

wherein the memory is configured with additional instructions and execution of the additional instructions by the microprocessor cause the microprocessor to:

input a count of on-off cycles of IR light emitting diodes of the IR emitter as indicated in diagnostic data and received via the IR receiver from the IR emitter; and communicate the count of on-off cycles to the application executing on the portable computing device.

2. The device of claim 1, wherein the transceiver includes a radio signal transmitter.

3. The device of claim 1, wherein the transceiver includes an IR light emitter.

4. The device of claim 1, wherein the transceiver includes an IR receiver attached to the support structure and coupled to the microprocessor.

5. The device of claim 1, further comprising:

a connector electrically coupled to the interface circuit, attached to the support structure and configured to mechanically and electrically engage with and disengage from a data port on a portable computing device.

6. The device of claim 1, wherein the interface circuit includes a radio signal transceiver for wirelessly communicating with the portable computing device.

7. A method of configuring an infrared (IR) emitter, comprising:

establishing communication between a programming device and an application executing on a portable computing device;

receiving, by the programming device, commands from the application;

transmitting the commands from the programming device to the IR emitter, wherein the commands cause the IR emitter to:

program memory of the IR emitter with configuration data including a vehicle identifier of a vehicle to which the IR emitter is assigned; and transmit, from the memory of the IR emitter, data associated with operation of the IR emitter;

receiving, by an IR receiver of the programming device, a count of on-off cycles of IR light emitting diodes of the IR emitter as indicated in diagnostic data and received from the IR emitter via the IR receiver in response to the commands; and communicating the count of on-off cycles from the programming device to the application on the portable computing device.

8. The method of claim 7, wherein:

the commands include a verification command that causes the IR emitter to transmit current configuration data programmed in the memory of the IR emitter, and the receiving data from the IR emitter includes receiving the current configuration data in response to the verification command.

9. The method of claim 7, wherein the transmitting the commands from the programming device to the IR emitter includes generating a radio signal that encodes the commands.

10. The method of claim 7, wherein the transmitting the commands from the programming device to the IR emitter includes generating an IR light signal that encodes the commands.

11. The method of claim 7, wherein the establishing communication between the programming device and the application executing on the portable computing device includes establishing communication via a wired connection between the programming device and the application executing on the portable computing device.

12. The method of claim 7, wherein the establishing communication between the programming device and the application executing on the portable computing device includes establishing communication via a wireless connection between the programming device and the application executing on the portable computing device.

13. A system for configuring an infrared (IR) emitter, comprising:

a portable computing device;

a support structure;

a microprocessor attached to the support structure;

an interface circuit attached to the support structure and configured to provide communications between the microprocessor and the portable computing device;

a memory attached to the support structure and coupled to the microprocessor, wherein the memory is configured with instructions and execution of the instructions by the microprocessor cause the microprocessor to:

communicate with an application executing on the portable computing device; and initiate transmission of commands to the IR emitter, wherein the commands cause the IR emitter to:

program memory of the IR emitter with configuration data including a vehicle identifier of a vehicle to which the IR emitter is assigned; and transmit, from the memory of the IR emitter, data associated with operation of the IR emitter; and a transceiver attached to the support structure and coupled to the microprocessor, wherein the transceiver includes an IR receiver attached to the support structure and coupled to the microprocessor, and the transceiver is configured to:

transmit the commands and the configuration data to the IR emitter; and receive data from the IR emitter in response to the commands;

wherein the memory is configured with additional instructions and execution of the additional instructions by the microprocessor cause the microprocessor to:

input a count of on-off cycles of IR light emitting diodes of the IR emitter as indicated in diagnostic data and received via the IR receiver from the IR emitter; and communicate the count of on-off cycles to the application executing on the portable computing device.

14. The system of claim 13, wherein the transceiver includes a radio signal transmitter.

15. The system of claim 13, wherein the transceiver includes an IR light emitter.

16. The system of claim 13, wherein the transceiver includes an IR receiver attached to the support structure and coupled to the microprocessor.

17. The system of claim 13, further comprising:

a connector electrically coupled to the interface circuit, attached to the support structure and configured to mechanically and electrically engage with and disengage from a data port on a portable computing device.

18. The system of claim 13, wherein the interface circuit includes a radio signal transceiver for wirelessly communicating with the portable computing device.

* * * * *